US011732990B2

(12) United States Patent
Lvov

(10) Patent No.: US 11,732,990 B2
(45) Date of Patent: Aug. 22, 2023

(54) COMPENSATING MUZZLE BRAKE (CMB) WITH SUPERSONIC GAS STREAM INTERRUPTION SYSTEM

(71) Applicant: Denis Emestovich Lvov, Saint-Petersburg (RU)

(72) Inventor: Denis Emestovich Lvov, Saint-Petersburg (RU)

( * ) Notice: Subject to any disclaimer, the term of this patent is extended or adjusted under 35 U.S.C. 154(b) by 0 days.

(21) Appl. No.: 17/385,694

(22) Filed: Jul. 26, 2021

(65) Prior Publication Data

US 2022/0099402 A1 Mar. 31, 2022

(51) Int. Cl.
*F41A 21/36* (2006.01)

(52) U.S. Cl.
CPC ..... *F41A 21/36* (2013.01)

(58) Field of Classification Search
CPC ..... F41A 21/30; F41A 21/32; F41A 21/325; F41A 21/34; F41A 21/36; F41A 21/38
USPC ..... 89/14.3
See application file for complete search history.

(56) References Cited

U.S. PATENT DOCUMENTS 6,216,578 B1 * 4/2001 Ledys ..... F41A 21/36 89/14.3
7,032,339 B1 * 4/2006 Bounds ..... F41A 21/36 42/1.06
7,308,967 B1 12/2007 Hoel
7,600,461 B1 * 10/2009 Cler ..... F41A 21/36 89/14.3
7,954,414 B2 * 6/2011 Dueck ..... F41A 21/36 89/14.3
8,087,337 B1 * 1/2012 Cary ..... F41A 21/36 89/14.3
8,555,765 B2 * 10/2013 Graham, II ..... F41A 21/325 89/14.3
8,991,552 B2 3/2015 Latka
9,228,789 B1 * 1/2016 Oglesby ..... F41A 21/36
9,303,939 B1 * 4/2016 Brinkmeyer ..... F41A 21/38
10,024,618 B1 * 7/2018 Moore ..... F41A 21/36
10,082,355 B2 * 9/2018 Addis ..... F41A 21/36
10,126,085 B2 * 11/2018 Deros ..... F41A 21/34
10,612,878 B1 * 4/2020 Salvador ..... F41A 21/325
11,262,150 B1 * 3/2022 VanFossan ..... F41A 21/36
(Continued)

FOREIGN PATENT DOCUMENTS

DE 102011010639 B4 7/2015
RU 2266507 C1 12/2005
(Continued)

*Primary Examiner* — Jonathan C Weber
(74) *Attorney, Agent, or Firm* — Aird & McBurney LP

(57) ABSTRACT

FIELD: gas units.
SUBSTANCE: muzzle brake-compensator (MBC) with a system for interrupting a supersonic gas flow contains a housing, annular elements connected to each other by cutting off chambers with nozzles. The nozzles are united by an internal through channel for the passage of the projectile and the gas jet. In the working area of each cut-off chamber, at least one side outlet window is located so that when the MBC is installed on the end of the weapon barrel, the side outlet windows of each chamber are oriented perpendicularly or at an angle back to the direction of the outgoing gases. EFFECT: technical result is an increase in the effectiveness of the muzzle device, a decrease in recoil and a decrease in toss when fired.

10 Claims, 4 Drawing Sheets

(56) References Cited

U.S. PATENT DOCUMENTS

| | | | | |
|---|---|---|---|---|
| 2008/0083321 | A1* | 4/2008 | Dueck | F41A 21/36 89/14.3 |
| 2011/0203447 | A1* | 8/2011 | Dueck | F41A 21/36 89/14.3 |
| 2012/0180623 | A1* | 7/2012 | Graham, II | F41A 21/325 89/14.4 |
| 2016/0169606 | A1* | 6/2016 | Joplin | F41A 21/36 42/1.06 |
| 2016/0341510 | A1* | 11/2016 | Brinkmeyer | F41A 21/38 |
| 2017/0023326 | A1 | 1/2017 | Wilson | |
| 2017/0343311 | A1* | 11/2017 | Deros | F41A 21/36 |
| 2018/0017352 | A1* | 1/2018 | Addis | F41A 21/36 |
| 2018/0292164 | A1* | 10/2018 | Thompson | F41A 21/36 |
| 2021/0199401 | A1* | 7/2021 | Magee | F41A 21/30 |
| 2022/0042759 | A1* | 2/2022 | Holly | F41A 21/36 |

FOREIGN PATENT DOCUMENTS

| | | | | |
|---|---|---|---|---|
| RU | 2558504 | C2 | 8/2015 | |
| RU | 2611461 | C1 | 2/2017 | |
| RU | 189743 | U1 | 5/2019 | |
| RU | 2702922 | C2 | 10/2019 | |
| RU | 2720500 | C2 | 4/2020 | |
| WO | WO-9854533 | A1 * | 12/1998 | F41A 21/36 |
| WO | WO-2017171980 | A2 * | 10/2017 | F41A 21/28 |

* cited by examiner

COMPENSATING MUZZLE BRAKE (CMB) WITH SUPERSONIC GAS STREAM INTERRUPTION SYSTEM

FIELD OF THE INVENTION

A compensating muzzle brake (CMB) relates to firearms, mainly to the construction of barrel, in particular, muzzle or muzzle attachment devices.

The CMB is applied as a muzzle attachment for compensating firearm barrel rise and/or recoil effects and can be used for improving combat characteristics of such arms in so far as to improve shooting accuracy. The CMB function is to improve firearm characteristics and performance applied for reducing recoil and for reducing rise after firing.

BACKGROUND

Patent RU189 743, published on May 31, 2019, IPC F41A 21/32 CPC, F41A 21/32, discloses a utility model provided in the form of nozzle having a through channel comprising several holes angularly arranged with respect to the attachment axis tipping, the holes are located on both sides of the nozzle symmetrically to the longitudinal axis of the nozzle and arranged down to the channel, wherein a lower end of the holes is closed by the walls provided by difference of diameters producing a step in the center. That way the compensating muzzle barrel interacts with powder combustion gases flowing out of the barrel and cuts off and redirects gases wherefrom using the effect of through holes. But structurally, jet streams directed upwards and downwards off the wall, thereby compensating each other cannot provide occurrence of any direct force for compensating rising effect of arms. Additionally, the chamber wall area below of the imaginary horizontal plane passing through the longitudinal axis is larger than the chamber wall area above it. The disadvantage thereof is a relatively low performance. The lines of holes have through ports for passing a gas stream at low pressure and speed, so that any force directed upwards and downwards fails to provide the barrel rise compensating effect.

Patent US 2017.0023326, published on Jan. 26, 2017, IPC F41A21/325, F41A21/38, discloses the invention of the reconstructed muzzle compensator that is equipped with removable sections which, while being adjusted, direct gas through gas outflow holes at one or several selected angles relative to the central axis interfacing with one or several gas outflow holes, and which comprise upper and lower through holes. However, these sections are put on the CMB from above and they are intended for redirecting outgoing gas streams but they do not influence the CMB internal gas dynamics and, consequently, fail to exceed efficiency of compensation effect for both recoiling and rising of a barrel.

Patent RU2 702 922, published on Oct. 14, 2019, IPC F41A 21/00, F41A 21/36, discloses the invention of a Shatrov muzzle brake that is equipped with the fixed cylinder-related target for a compensating projectile adapted for passing a projectile therethrough, and the target is provided in the form of radial projections on an internal surface of the cylinder for providing the impact-caused interaction between a projectile and the target. In this case, powder combustion gases make their force action be transferred to the circular partitions (diaphragms, membranes), thereby producing force acting in the direction opposite to that of motion of the sliding parts and braking it. However, the reaction as a response to any effect produced by collision of the movable body with the fixed body is used other than gas dynamics characteristics applicable with a gas streams passing through the partition (target). This is to relate to dynamic compensators. The problem is to simplify the construction other than to improve performance of the compensator.

Patent RU2 558 504, published on Aug. 10, 2015, IPC F41A 21/36, discloses a compensating muzzle brake provided in the form of a tubular barrel end nozzle which comprises tandem-connected aligned chambers, and the first chamber is provided with the through holes, the second chamber is provided with the gas outlets passing outside of the central channel tipped back and located on the both sides off the imaginary vertical plane, and the holes in the first chamber are located, so that to make them be oriented vertically as installed on the firearm barrel end in order to compensate the horizontal barrel deviation component after firing. The invention allows obtaining a simple construction, particularly, in the form of a single part which use provides compensation of not only recoil effect but also rise effect after firing. However, the invention does not allow improving performance of the muzzle attachment and increasing powder particle burn-down and gas cooling intensity. The effect for increasing density of a gas stream flowing out of the side holes of the compensator is not employed; no efficiency of the barrel recoil and rise compensation effect can be provided. As for the proposed technical findings, a derived reactive force is increased, but nevertheless in both cases a bullet-following gas stream turns back to be released away in the direction opposite to an action of fire and an amount of a bullet-followed supersonic gas stream fails to achieve large effect to cause stabilization of projectile flight due to the turbulent effect produced behind it.

The closest technically functional analog is the invention of the firearm muzzle attachment disclosed in Patent RU2 611 461, published on Feb. 22, 2017, IPC F41A 21/30, F41A 21/32, comprising cut-off chambers either of which consists of two washers having radius-rounded edges and diameter-varied bullet openings joined to each other by the circular body element. The cut-off chambers joined to the bullet channel via gas channels have washers located inside each cut-off chamber closer to the muzzle end of the barrel and they are integrally provided with the circular body element which joins washers of a chamber. The invention allows improving performance of the muzzle attachment and increasing powder particle burn-down and gas cooling intensity. However, the effect for increasing density of a gas stream flowing out of the side holes of the compensator is not employed since there is a single axially discharging hole only. This device solves the problem of dampening but not recoiling. As a result of specific design features, temperature of outflow gases may be reduced but it is a problem to provide efficiency of the barrel recoil and rise compensation effect.

As for the classical gas-reflecting type CMB, the compensation effect is achieved at the expense of separation of some portion of gases evacuated from the main stream of gases to follow a bullet (projectile), wherein they turn back and get discharged away in the opposite direction to an action of fire, so that the reactive fire-direction force is produced to reduce a firearm recoil effect.

But considering for an internal classical CMB channel, an outflow gas stream within a reflecting system has a solid supersonic jet pattern.

As referred to gas dynamics, it is known that a supersonic stream, unlike a subsonic stream, tends to push out any bodies and gases that come into collision with it and, so that saving its long-distance path. Energy is transferred between gaseous molecules traveling in a wave-like pattern (pressure waves), where the wave front advances at sound velocity and, therefore, the supersonic stream body lining and interacting process runs differently unlike the subsonic process.

Consequently, the reflecting system in the classical gas-reflecting type CMB will reflect only that portion of a gas stream which is "planed off" with the chamber partition edges. Molecules in the central portion of a gas stream will not affect (with no additional pressure produced) the process of outflow from the CMB chamber ports and, consequently, will not decrease recoil and rise power.

As it is known, a reactive force is a gas velocity and mass flow function which in its turn, depends on that of the chamber pressure. In the given examples of the known CMB constructions, the main gas stream does not come into collision with obstacles obtaining supersonic velocity of outflow and, as a result, low pressure since the laws of hydrodynamics state out that temperature and pressure drop down during acceleration of gas other than velocity that goes up and, vice versa, gas velocity drops down during deceleration of gas but temperature and pressure go up.

Subject to the aforesaid, the CMB known in the prior art and that of the known type will fail to provide potentially available performance. Additionally, the disadvantage of constructions in the prior art is that a bullet is followed by a considerable amount of the main gas stream producing turbulence and asymmetric perturbation action, thereby affecting grouping.

According to gas dynamics it is also known that a supersonic gas stream will be exposed to a normal shock wave to cause sharp reduction of velocity down to the subsonic one, thereby resulting in increase of pressure and temperature in the events of collision with an obstacle that significantly exceeds the sectional area of the stream but a smaller obstacle will be passed by the gas stream while being exposed to a number of oblique shock waves.

SUMMARY OF THE INVENTION

As for the proposed findings, the following technical result is provided:

improving performance of the muzzle attachment reducing recoil and rise of the barrel after firing.

The technical result is achieved in that the compensating muzzle brake (CMB) with the supersonic gas stream interruption system comprising the body provided with circular elements and comprising interconnected cut-off chambers with nozzles combined by an internal through channel for passing a projectile (bullet) and a gas stream, therein a reactive force of gases flowing out of the barrel after the fired projectile (bullet) is used in the CMB for its functioning. The newly proposed CMB body is provided in the form of a tubular barrel end nozzle located at the exit section of the barrel; and an internal through channel is separated into circular active zones sited in each cut-off chamber which are located sequentially and aligned with the firearm barrel. At least one side through outlet port is located in the active zone of each cut-off chamber in such a way that, with the CMB installed on the firearm barrel end, the side through outlet ports of each chamber are oriented perpendicularly or angularly back to the barrel axis and have the total sectional area "$s_1$" for each chamber at least twice the area "$s_2$" of the barrel channel cross-section. The cut-off chamber is provided with a flat annular surface with an outer diameter of not less than 2 calibers having a hole in the center for passing a projectile (bullet) without obstruction which is a part of a volumetric circular element located opposite to the nozzle inlet section or critical cut-off chamber section, and circular active zones "a" produced as a result of climb and subsequent reflection (deflection) to the flat annular surface (for example, a washer) of a gas stream flowing via the nozzle out of central channel "c" to the active zone of each cut-off chamber. A distance "$h_1$" from each circular element to a critical nozzle cross-section (or inlet section) of each cut-off chamber is calculated with reference to pressure difference inside the cut-off chamber and forward of the critical chamber nozzle cross-section (or inlet section) and with reference to outgoing gas density, viscosity and temperature, and said distance is equal to at least a caliber, wherein the circular element (for example, plate-shaped) is a gas-reflecting (deflecting) plate-shape disk with a hole in the middle provided in its central part with a flat annular surface (washer) interfaced with a peripheral convex end of the cut-off chamber by a smooth passage providing for smooth turnback and reflection (deflection) of gas sidewards and backwards with reference to the direction of fire to the side through outlet port. A normal shock wave is formed in the circular element, in a climbing supersonic gas stream in the space between the flat annular surface and critical nozzle cross-section. For example, the length of each cut-off chamber is at least one caliber and the diameter of the central annular surface hole is, in particular case, sufficient for passing a projectile without obstruction. This being said in particular case, each circular element is provided as a volumetric item; in the central part it has a washer (i.e., annular) shape and on the periphery—a toroidal surface—with the toroidal surface smoothly interfaced on the periphery with the truncated cone of the inner surface of the nozzle. In other words, the inner diameter of the nozzle increases in the direction of fire.

The cut-off chamber is provided proceeding from that, when a supersonic gas stream flows out of the barrel and comes to the flat annular surface, gas-dynamic and thermodynamic conditions are produced in the circular element, so that they are to be essential and significant for reliable formation of a stable normal shock wave produced in the space between the critical nozzle cross-section in the cut-off chamber and flat annular surface. For example, the circular element may be provided in the form of the plate having a flat bottom being a flat annular surface and volumetric or flat borders along the edges which are interfaced with side through outlet ports on the periphery.

The side through outlet port (or ports) may be shaped in any way of either holes or apertures since only the gas outlet area can significantly affect the outflow process. In particular case, the cut-off chambers may have a separable design being joined, for example, with threaded items or pins. But structurally, they are more suitable for keeping in the common body.

Each volumetric circular element may be sectionally shaped from a flat washer which toroidal surface is smoothly interfaced on the periphery with the nozzle and side through outlet port.

BRIEF DESCRIPTION OF DRAWINGS

The following drawings illustrate the proposed construction less all the CMB versions.

DESCRIPTION OF PROPOSED EMBODIMENTS OF THE INVENTION

Figure 1C:
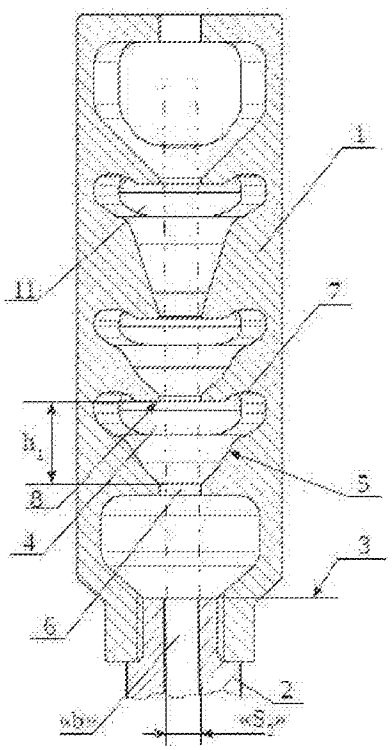
FIG. 1C is a general view of a compensating muzzle brake, along longitudinal section A-A of FIG. 1B.
Figure 1B:
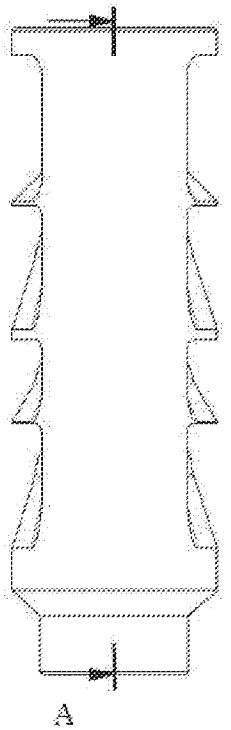
FIG. 1B is a general and side view of a compensating muzzle brake.
Figure 1A:
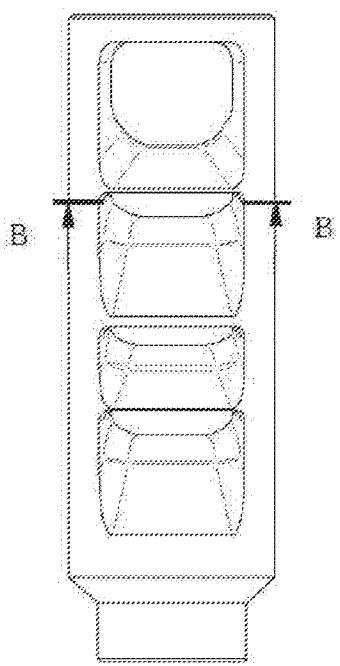
FIG. 1A is a general view of a compensating muzzle brake.
Figure 1D:
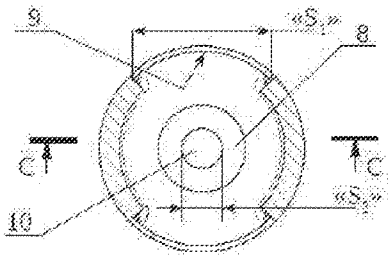
FIG. 1D is a general and cross-section view of a compensating muzzle brake, along cross-section B-B of FIG. 1A.
Figure 2:
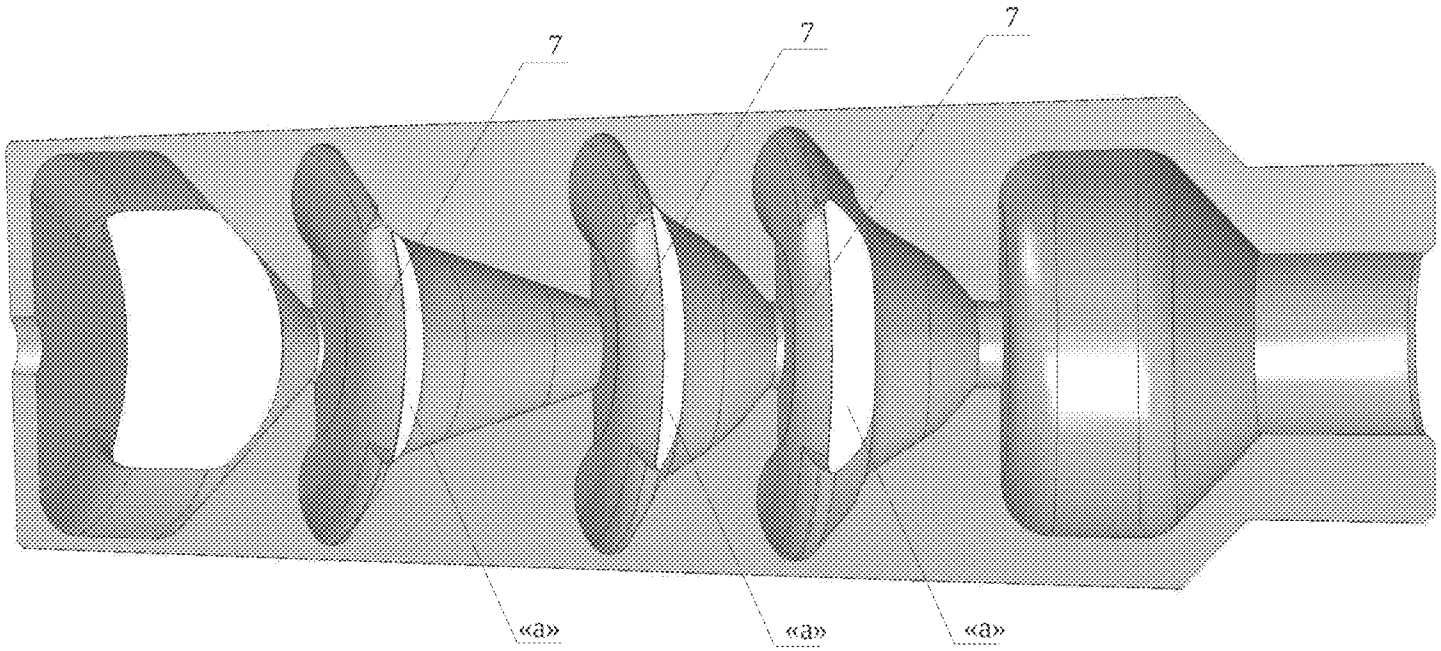
FIG. 2 is an isometric sectional view of the CMB.
Figure 3:
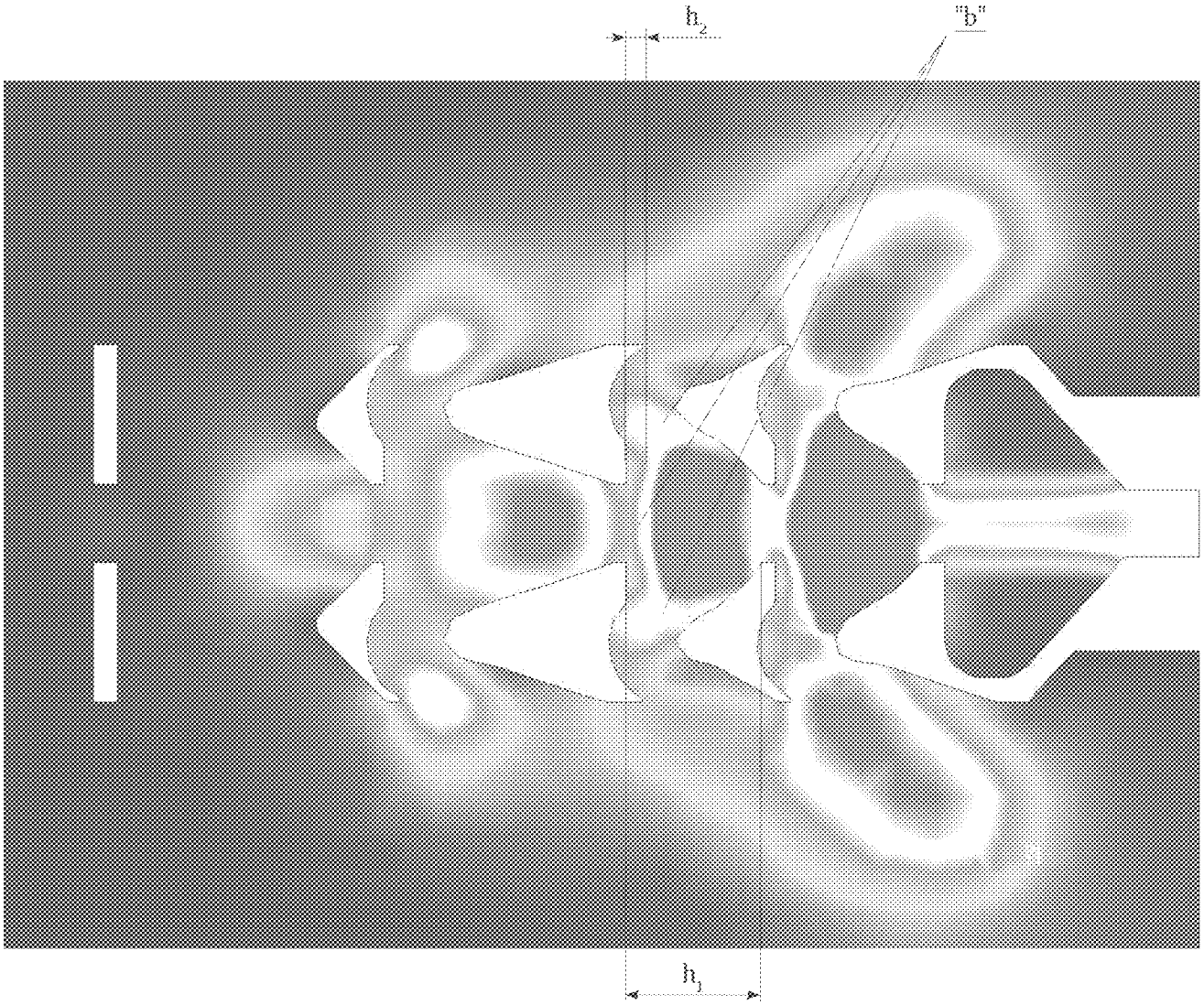
FIG. 3 is a digital visualization of velocity of gas streams.
Figure 4:
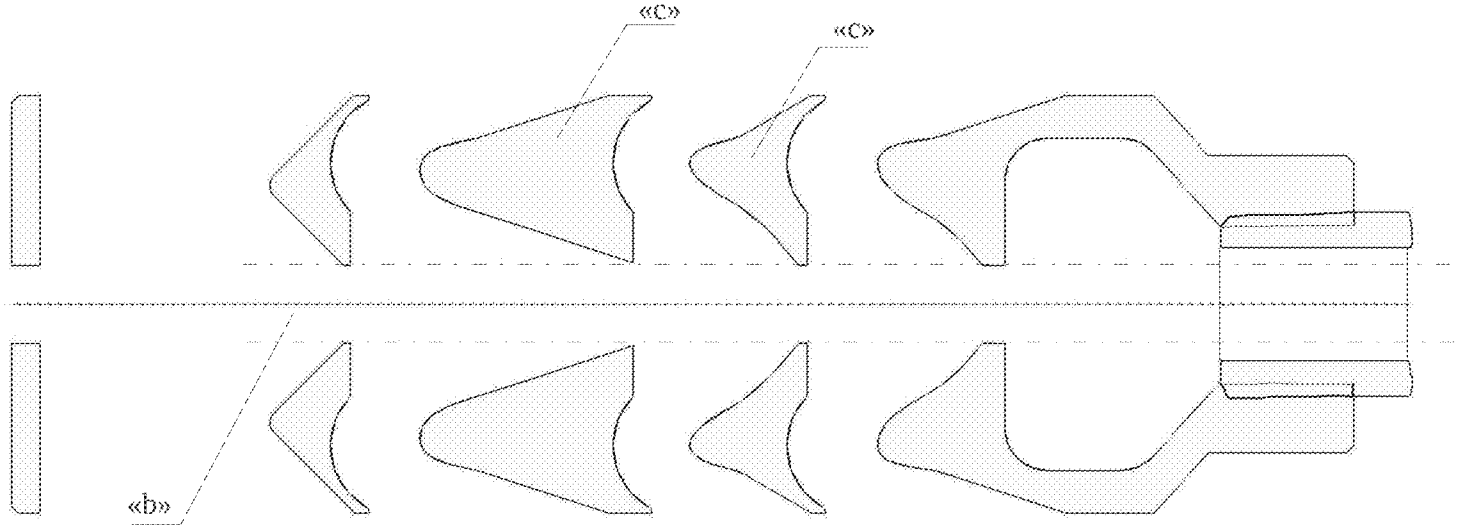
FIG. 4 is a gas stream monogram with digital visualization of normal shock waves when confronted with the flat circular elements.

The CMB is designed as follows. The tubular nozzle has a body (1) that is placed on barrel end (2). Attached to the muzzle end of the barrel (3) or through the intermediate chamber is a first cut-off chamber (4) that comprises a nozzle (5) having a critical cross-section (6) that is the narrowest part, and then the nozzle is interfaced with the circular element (7), a part of which is a flat annular surface (8). A circular element (7) has a shape of a plate in the cross-section and includes a concavely curved surface, for example, having a surface in the form of a circular groove (e.g., a toroidal surface) that is interfaced with a surface of side through outlet ports (9) on the periphery and has a bottom in the form of a flat annular surface (8) in the center with an outer diameter of not less than 2 calibers and having a hole (10) in the center for passing a projectile without obstruction. The first cut-out chamber (4) is interfaced with the second cut-off chamber (11) that includes the same elements. One through five cut-out chambers may be used. A length of each chamber $h_1$ is digitally simulated using the model that meets the conditions for a circular active zone "a" in which is provided formation of a normal shock wave in an incoming supersonic gas stream produced between a flat circular element (8) and critical cross-section (6) of the nozzle (5). For formation of a normal shock wave, the requirement is that the supersonic gas stream flowing out of the nozzle (5), while climbing on the flat annular surface (8), in each cut-out chamber (4) gas-dynamic and thermodynamic conditions are produced, so that they are to be essential and significant for reliable formation of a stable normal shock wave produced in the space between the critical cross-section (6) of the nozzle (5) of this chamber (4) and the flat annular surface (8) acting as a reflecting (deflecting) obstacle. Since parameters of the outflow stream vary as long as it runs through the CMB, a length of each cut-out chamber (4) is simulated individually using a digital model. An example of gas outflow is shown in the digital model (FIG. 3). A normal shock wave is occurred at the distance $h_2$ from the obstacle a stream climbs on, particularly, from the flat annular surface (8) the distance to which $h_1$ from the critical cross-section (6) of the nozzle (5) of the chamber (4) depends on pressure difference inside the cut-off chamber (4), as well as on density, viscosity and temperature of the outflow gas and diameter of the critical cross-section (6). Such distance $h_1$ is calculated individually for each cut-off chamber. A flat annular surface (8) is provided with an outer diameter of not less than 2 calibers. Circular active zones "a" are employed inside the circular element (7), wherein a high-pressure domain "b" is formed at the expense of the normal shock wave caused by interaction with the flat annular surface (8) of the gas stream flowing via the nozzle (5) out of the central channel "c" inside the active zone "a" of each cut-off chamber (4). The side through outlet port (9) is provided in such a way that, with the CMB installed on the barrel end (2) of the firearm, the side through outlet ports (9) of each chamber (4) are oriented perpendicularly or angularly back to the barrel axis and have the total sectional area "$s_1$" for each chamber that is at least twice the area "$s_2$" of the cross section of the central channel ("c") of the barrel (2). A circular element (7) is a gas-reflecting (deflecting) plate-shape disk with a hole (10) in the middle provided in its central part with a flat annular surface (8) interfaced with a peripheral end of the cut-off chamber (4) by a smooth passage providing for smooth turn-back and reflection (i.e., deflection) of gas sidewards and backwards with reference to the direction of fire to the side through outlet port (9). The abovementioned configuration of the cut-off chamber (4) provides conditions wherein the distances in the cut-off chamber (4) between the flat annular surface (8) and critical cross-section (6) of the nozzle (5) are sufficient for forming a stable normal shock wave.

Accordingly, the terminology accepted in this description meet the following meanings. A cut-off chamber is a nozzle, terminated by a circular element (plate) wherein a flat annular surface (a washer of annular shape) is applied, and the nozzle has a side through outlet port.

A critical cross-section of the nozzle is the least cross-section of the nozzle wherein it corresponds to the cross-section of an inlet of the nozzle.

The CMB functions as follows.

On the path of a gas stream, at a calculated distance sufficient for formation of the normal shock wave, a so-called Mach disk, being equal to not less than one caliber (i.e., inner diameter) of the critical cross-section (6) of the nozzle (4), is placed a plate-shaped reflector (deflector) (i.e., a circular element (7)) based on the flat disk (i.e., flat annular surface (8)) which diameter is not less than two calibers. The peripheral outlet end of the cut-off chamber (4), by means of a smooth passage, provides for smooth turn-back and reflection (deflection) of gas sidewards and backwards with reference to the direction of fire from the side through outlet ports (9) that are located on the side of the nozzle (5).

In this case, a gas stream interacting with the flat annular surface (8) will be exposed to a normal shock wave "b" and, as a result, will produce in the cut-off chamber (4), for gas streams flowing out of the side through outlet ports (9), pressure to be twice as much as pressure in the classical CMB of the known construction. This is illustrated in FIG. 3 showing distribution of gas streams in the proposed construction.

High pressure in the chamber will cause, in its turn, creation of a significantly exceeded compensating reactive force. A normal shock wave is described, for example, in the publication [Mkhitaryan A. M. Aerodynamics, —M: "Mechanical Engineering", 1976].

By the normal shock effect is explained that while decelerating a supersonic gas stream, when gas particles transfer from the lower pressure domain to that of higher pressure, an abrupt (breaking) variation of parameters is produced—i.e. formation of a surface of discontinuity called a shock wave. Surfaces of discontinuity may be plain or curved differently oriented towards a velocity vector. If a surface of discontinuity is normal to the stream velocity, a shock wave is called normal. A shock wave (or a blast wave) is followed by abrupt decrease of speed and increase of pressure and temperature with kinetic energy being run out. Shock waves are produced not only when gas is freely flowing out of the jet nozzle to atmosphere but, for example, when supersonic current takes place inside the channel. Distances $h_1$ are calculated on the base as follows:

If an obstacle on which a supersonic stream climbs on is a thin-walled pipe having thickness of walls less than a half of an inside diameter of the pipe, on the ends of the pipe will be formed oblique shock waves with a stream "resting" on them being forced to pass by an obstacle, i.e. only that stream will pass by the pipe from its outside that has time to expand to the outside diameter of the pipe or more by the time of climb. As for a central portion of the stream (that carries a major part of gas mass according to the Gauss distribution law), it continues running in the main pipe channel;

The useful reactive force in the CMB is formed through the effect that causes a gas portion following a projectile turning back and kicking back in the direction opposite to an action of fire. The more portion of gas being kicked backed at higher velocity, the more compensating force is produced.

A normal shock wave, if produced on a path of a gas stream acting as a higher pressure zone, will be, in a way, a dynamic obstacle to a stream running axially and, in its turn, will cause increasing gas rate flowing sidewards.

If a supersonic gas stream climbs on a thick-wall pipe having thickness of walls equal or more than a half of an inside diameter of this pipe, as a result of interaction with gas trying to pass an obstacle in the form of pipe end walls, forward of the entire end surface of the pipe will be produced a normal shock wave. Therefore, an outer diameter of the flat annular surface (8) is selected as equal to not less than two calibers.

Parameters and number of reflecting chambers may be either calculated initially or selected sequentially on the basis of gas outflow numerical simulation results throughout the finite element method: for example, with gas outflow parameters simulated at the exit section of the barrel, if based on the numerical simulation results, an optimal geometry of the first chamber (angle of opening and length of the nozzle; a distance to the flat annular surface that provides for formation of a normal shock wave in front) is selected; then, on the basis of knowledge of obtained parameters of gas flowing out of the channel after the first chamber, the second chamber geometry is selected and so forth until a gas stream running axially out of the next chamber starts flowing out at the rate not less than velocity of sound (thereby making impossible for a gas stream to run up with a bullet flying at supersonic velocity and avoiding any harmful perturbation effect it can be exposed to), or until the total length of sequentially assembled cut-off chambers (4) achieves the maximum permissible length restricted by specific design requirements.

Formation of a normal shock wave inside the cut-off chamber forward of the flat annular surface is resulted from Navier-Stokes equations used for defining gas stream particle motion laws according to which the more pressure inside a stream to exceed pressure outside, the more angle of stream opening. For example, a vacuum-running stream will not flow out like a jet but a cloud, and if a stream flows into medium pressurized similarly likewise the stream, it does not actually expand and its flow-out pattern will look like a cord. In the case under study, a stream flows out into the terrestrial atmosphere in normal pressure and temperature conditions and, therefore, if to refer, for example, to pressure difference inside and outside a stream including its density, viscosity and gas temperature, a distance towards "the first barrel"—a location wherein a stream expands enough to produce a normal shock wave visualized as a Mach disk—can be calculated exactly enough. For normal atmospheric conditions and typical hot gases, a distance from the nozzle section to the normal shock wave will normally be not less than the nozzle diameter, but if gas in the vessel (cut-off chamber), a stream flows to, fails to run out in proper time, it will be compensated by increased pressure with the angle of opening reduced, thereby entailing increase of a length of distance to "the first barrel"—i.e. a Mach disk distance—a normal shock wave. The digitally simulated model of the proposed device is based on this principle. With these conditions satisfied, it is possible to gain maximum reactive deceleration performance by using a muzzle attachment in order to decrease recoil and rise effects after firing.

Any side effect on using a plate-shaped reflecting system will be caused by radical decrease of forward-running gas flow rate, for example, when using 4 or more cut-off chambers (4) wherein supersonic flow of gas following a bullet is actually deteriorated at the last chamber outlet, thereby resulting in decrease of bullet perturbation effect and improvement of grouping.

At the nozzle exit section but forward of the set-off chambers, in particular case, an additional intermediate chamber without any original outlet ports may be placed. Its function is to be a receiver (pre-collector) of powder combustion outflow gases either for improving a steady outflow pattern or for burning powder combustion gases up (for example, to reduce flashing effect). Also, a lateral surface of this chamber is adapted, where required, for boring through holes in the right required direction, so that additional gas streams creating additional reactive forces can be formed as those intended for compensating individual features of arms, ammunition or shooters.

According to the shooting results obtained at the open-air field when testing a 223 caliber sporting rifle fitted with the described CMB unit by the elite sports shooter who used just low-grade standard cartridges for firing twice per a series, a 300 m spread did not exceed 12 cm, what was impossible using any other CMB units in the world market.

The invention claimed is:

1. A compensating muzzle brake for use with a firearm having a barrel having an internal barrel channel for passing a projectile and a gas stream in a direction of fire, the barrel channel defining a central barrel axis, and the barrel channel having a cross-sectional area, $s_2$, wherein the compensating muzzle brake comprises:

a tubular body installed or for installation on the barrel, wherein the tubular body defines:

an internal through channel for passing the projectile and the gas stream, wherein the through channel is aligned and continuous with the barrel channel when the tubular body is installed on the barrel; and at least one internal cut-off chamber, wherein each one of the at least one cut-off chamber comprises a nozzle and at least one side port, and is terminated by a circular element such that, with the tubular body installed on the barrel:

the nozzle defines an inlet for passing the projectile and the gas stream from the internal through channel into the cut-off chamber; wherein an inner diameter of the nozzle gradually increases along the nozzle in the direction of fire from the inlet toward the circular element; wherein a caliber of the nozzle is defined by the inner diameter the nozzle at the inlet;

the at least one side through outlet port is located in a side of the nozzle and oriented perpendicularly or at a non-perpendicular angle back toward the central barrel axis; wherein a total sectional area, $s_1$, of the at least one side through outlet port for each one of the at least one cut-off chamber is at least twice the cross-sectional area, $s_2$, of the barrel channel;

the circular element comprises a flat annular surface having an outer diameter of at least 2 times the caliber and having a central hole for passing the projectile and the gas stream from the cut-off chamber to the internal through channel; wherein the flat annular surface faces opposite to the direction of fire and is located opposite to the inlet of the nozzle; wherein a distance, $h_1$, in the direction of fire, from the flat annular surface to the inlet of the nozzle is equal to at least the caliber; wherein the at least one side through outlet port is located, in the direction of fire, between the inlet of the nozzle and the flat annular surface; and the circular element further comprises a concavely curved surface that interfaces a periphery of the flat annular surface with a peripheral end of the nozzle and provides for deflection of gas sidewards and opposite to the direction of fire and through the at least one side through outlet port.

2. The compensating muzzle brake of claim 1, wherein the at least one cut-off chamber comprises a plurality of cut-off chambers that are arranged sequentially and spaced apart, in the direction of fire, along the tubular body and interconnected by the internal through channel of the tubular body.

3. The compensating muzzle brake of claim 2, wherein the cut-off chambers are separable from each other.

4. The compensating muzzle brake of claim 2, wherein the distance, $h_1$, for a first one of the plurality of the cut-off chambers differs from the distance, $h_1$, for a second one of the plurality of the cut-off chambers.

5. The compensating muzzle brake of claim 2, wherein the plurality of the cut-off chambers comprises five or less cut-off chambers.

6. The compensation muzzle brake of claim 5, wherein the plurality of the cut-off chamber comprises three cut-off chambers.

7. The compensating muzzle brake of claim 1, wherein an inner surface of the nozzle has a truncated conical shape.

8. The compensating muzzle brake of claim 1, wherein the concavely curved surface comprises a toroidal surface.

9. The compensating muzzle brake of claim 1, wherein the at least one side through outlet port is oriented perpendicularly to the central barrel axis.

10. The compensating muzzle brake of claim 1, wherein the at least one side through outlet port is oriented at a non-perpendicular angle back toward the central barrel axis.

* * * * *